US005555603A

United States Patent [19]

Chester

[11] Patent Number: 5,555,603

[45] Date of Patent: Sep. 17, 1996

[54] SLIDING CURTAIN CLIP AND GUIDE TRACK

[75] Inventor: Brian Chester, Potts Point, Australia

[73] Assignee: Trychest Proprietary Limited, Potts Point, Australia

[21] Appl. No.: 293,707

[22] Filed: Aug. 22, 1994

[51] Int. Cl.[6] ..... E05D 15/00

[52] U.S. Cl. ..... 16/87.2; 16/87.4 R

[58] Field of Search ..... 16/87.2, 87 R, 16/87.4 R, 87.8, 95 R, 96 R, 96 D, 93 R, 93 D

[56] References Cited

U.S. PATENT DOCUMENTS

| | | | |
|---|---|---|---|
| 3,378,879 | 4/1968 | Stall | 16/87.4 R |
| 3,820,191 | 6/1974 | Gay | 16/87.2 |

FOREIGN PATENT DOCUMENTS

| | | | |
|---|---|---|---|
| 805469 | 5/1960 | France | 16/87.2 |
| 1232711 | 1/1967 | Germany | 16/87.2 |
| 454378 | 6/1968 | Switzerland | 16/87.2 |
| 483240 | 2/1970 | Switzerland | 16/87.2 |

*Primary Examiner*—Chuck Y. Mah
*Attorney, Agent, or Firm*—Smith-Hill and Bedell

[57] ABSTRACT

A sliding curtain clip (5) made of a stiffly resilient plastics material, has a hook (6) at its lower end and three upwardly projecting arms (8 and 9) at its upper end. The arms extend upwardly from a flattened neck (7) and diverge in opposite directions from the plane of the neck. Oppositely-directed bulges (11) at the upper ends of the arms run along respective guide surfaces above the slot. The clip is engaged with the slot by being forced upwardly through it, the upper ends of the bulges providing ramp surfaces (12) which flex the arms towards one another to enable their upper ends to pass upwardly through the slot. The lower portions (13) of the bulges (11) provide ramp surfaces (13) which flex the arms towards the plane of neck when the clip is pulled downwards to detach it from the underside of the slot.

3 Claims, 2 Drawing Sheets

SLIDING CURTAIN CLIP AND GUIDE TRACK

FIELD OF THE INVENTION

THIS INVENTION relates to a moulded clip and is more specifically concerned with a clip designed to travel along a track and to support a strip of fabric such as a curtain beneath the track.

STATE OF THE ART

The conventional form of support clip for a skirt, curtain or other strip of fabric, is provided with runners which run along an inverted T-shaped track and which are fixed to the upper end of the depending support which is attached to the upper marginal edge of the strip of fabric. Such a support clip is shown in Australian Patent No. 224247. Although such a form of clip is functional, it does not lend itself to locations where a clean appearance is required. Advances in plastics technology have enabled the development of moulded articles having an exceptionally clean appearance which would be marred by the use of exposed tracks and clips of relatively complex construction.

OBJECT OF THE INVENTION

An object of this invention is to provide a clip which is cheap to manufacture, simple to use and provides a support for a fabric strip or other article which is to be suspended beneath a supporting track.

THE INVENTION

In accordance with the present invention, a clip for attachably fitting into a slot extending along the underside of a tubular track, is moulded in one piece from a resilient plastics material and has a neck portion towards its upper end which is slidable in its own plane below the slot, divergent arms extending upwardly beside one another from the neck so that they extend through axially spaced positions in the slot and are offset so that they also can be flexed towards the plane of the neck without obstructing one another, lateral bulges formed at the upper ends of the arms and extending respectively in opposite directions to provide sliders which engage the lower inside wall of the track along opposite margins of the slot, and ramp surfaces provided above and beneath the bulges for flexing the arms towards the plane of the neck when the upper end portion of the clip is thrust upwardly through the slot or is pulled forcibly down from the slot.

PREFERRED FEATURES OF THE INVENTION

Preferably the lower-end portion of the clip is formed as a hook which may be stitched or otherwise attached to the upper marginal edge of a strip of material which is to be suspended at spaced intervals by the clips from the track.

An advantage of the invention is that it provides a hidden track in the sense that it comprises a tube hidden from view and whose only access is by way of the slot extending along its underside. The clips are inserted into their mounted positions in the tube by being forced individually upwards through the slot. The opposite sides of the slot engage the ramp surfaces at the respective upper ends of the bulges to flex the arms resiliently towards one another and allow the bulges to pass upwardly through the slot. Once the bulges are inside the tube, the arms revert to their unflexed positions and the bulges prevent withdrawal of the clip from the track under normal load conditions. If it is required to remove the clips, they may be manually pulled down. The ramp surfaces on the undersides of the bulges then flex the arms towards the plane of the neck to allow the bulges to be drawn downwardly between the opposite sides of the slot.

INTRODUCTION TO THE DRAWINGS

The invention will now be described in more detail, by way of example, with reference to the accompanying drawing in which:

IN THE DRAWINGS

DESCRIPTION OF PREFERRED EMBODIMENT

Figure 1:
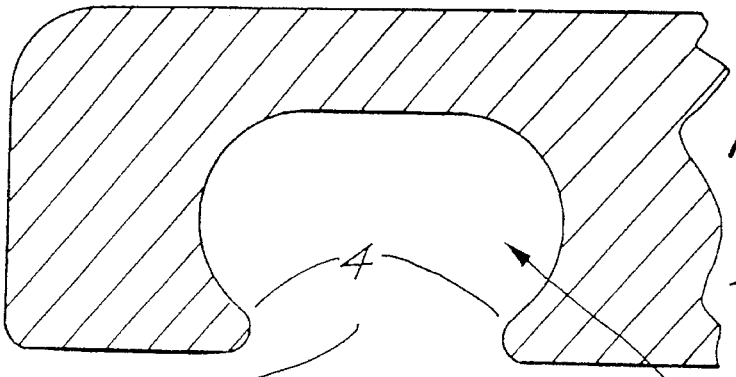
FIG. 1 is a vertical section through an edge portion of a table which is to have a vanity fabric skirt hung from it.

FIG. 1 shows part 1 of a moulded plastics table having a flattened hollow tubular track 2 extending along its underside close to one edge of the table. The track 2 has a slot entry 3 extending along its underside and is of substantially circular cross-section to provide two guide surfaces 4 respectively formed by the wall portions flanking the slot 3.

Figure 2:
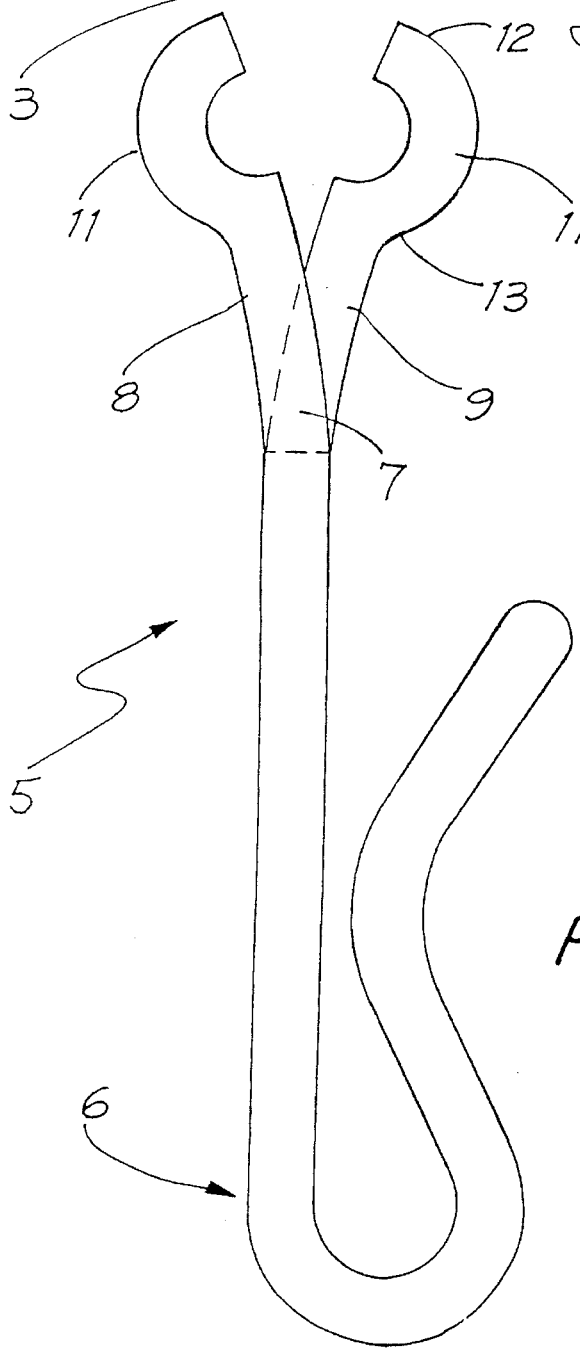
FIG. 2 is an end view of a clip to be used to support the vanity skirt.
Figure 3:
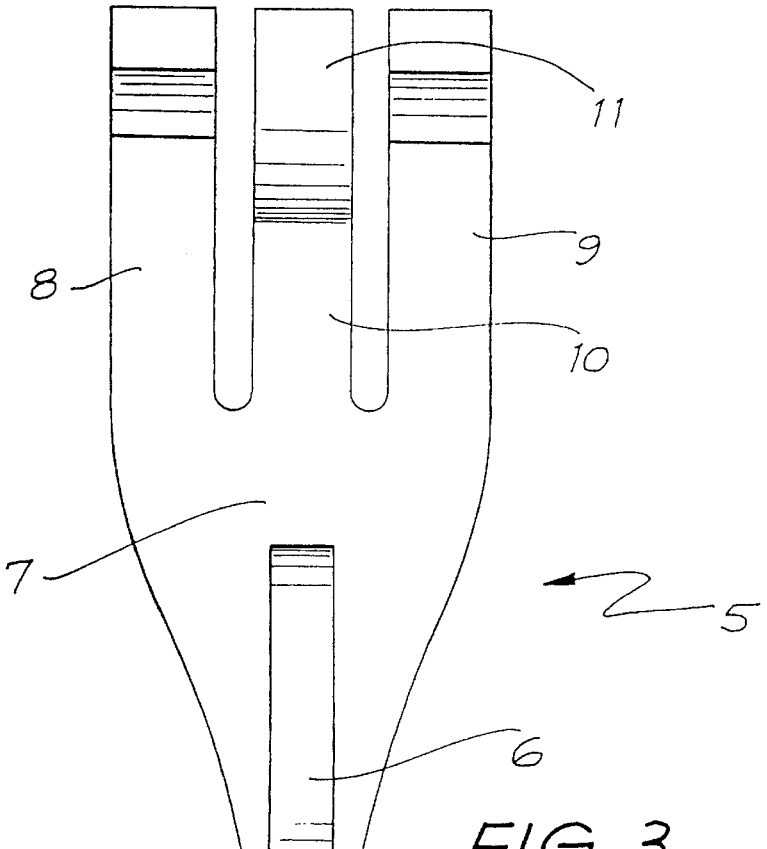
FIG. 3 is a side view of the clip of FIG. 2.
Figure 4:
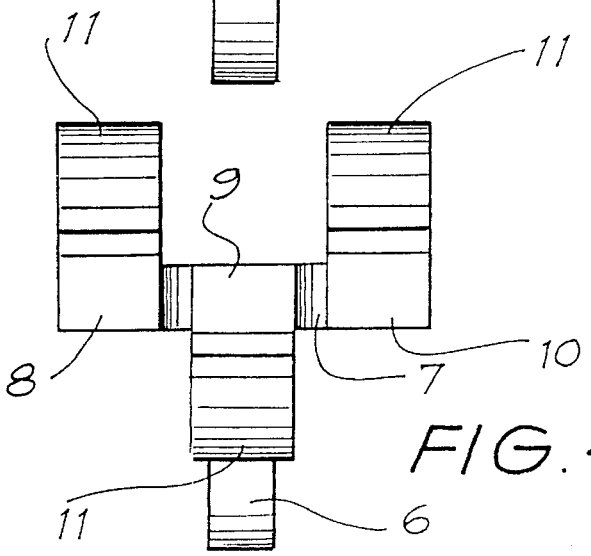
FIG. 4 is a plan view of the clip of FIG. 2.

FIG. 2 shows a clip 5 made of moulded plastics material which is stiffly but resiliently flexible. A suitable material for this purpose is one which has properties similar to nylon in that it is self-lubricating, clean in appearance, and relatively easy to mould. The clip 5 has a lower hook portion 6 and an upper portion comprising a neck 7 from which three arms 8, 9 and 10 extend divergently upwards as is apparent from FIG. 3. The three arms 8, 9 and 10 terminate in respective bulges 11. The bulges 11 of the arms 8, 10 project from one side of the upper end-portion of the clip and the bulge 11 of the other arm 9 projects from the other side of the clip as is clearly apparent from FIG. 2.

Each of the bulges provides an upper ramp surface 12 and a lower sliding surface 13.

OPERATION OF PREFERRED EMBODIMENT

The clip is mounted in position as follows:

Its upper end portion is placed beneath the slot entry 3 and it is then forced upwardly so that the ramp surfaces 12 at each side of the clip engage the sides of the entry to the slot and flex their associated arms 8, 9 and 10 inwardly towards the plane of the neck 7. This allows the bulges 11 to be forced upwardly through the slot entry 3. When the bulges have passed through the slot, they re-assume their former positions, as shown in FIG. 2, inside the tubular track 2. The sliding surfaces 13 then engage the two guide surfaces 4 flanking the inside of the track. Because the inside wall of the track 2 is made of plastics material having a low co-efficient of friction with the material of the clip, the clip can be slid smoothly along the track to any desired position. A vanity skid can thence suspended from the hook portions 6 of the clips 5.

If it is required to remove the clips 5 supporting the vanity skirt from the track, they are individually pulled downwards with sufficient force to cause the sliding surfaces 13 to slide down the sides of the slot 3 and thereby flex the arms 8, 9 and 10 towards the plane of the neck 7 so that the bulges 11 can be drawn downwardly through the slot 3.

A clip constructed as described above, has withstood being inserted into the track and withdrawn from the track 20,000 times without damage.

I claim:

1. In combination:

a track member having a horizontal underside, said track member being formed with an elongate slot that is open at the underside of the track member, the slot having a longitudinal entry and the track member including guide means extending longitudinally inside said slot on each side of the entry, and a plurality of clips each comprising a moulding of resiliently flexible plastic material and having an upper part fitted in the slot above the entry for sliding along the slot, a lower part forming a hook beneath the entry, and a neck that supports the hook from the upper part, and wherein the upper part of each clip comprises at least first and second divergent arms that extend upwardly from the neck through the entry, sliding surfaces on the arms engaging the guide means, and ramp surfaces on the arms for flexing them to facilitate insertion of the clip in the slot, the arms being in-line along the slot so that the first and second arms can be flexed together for insertion of the upper part of the clip in the slot or removal of the upper part of the clip from the slot without mutual interference of the arms.

2. A combination according to claim 1, wherein the upper part of each clip comprises a third arm that extends upwardly from the neck through the entry and is in-line along the slot with the first and second arms, with the second arm between the first and third arms, and wherein the first and third arms extend upward from the neck of the clip to one side of a vertical plane and the second arm extends upward from the neck to opposite side of the vertical plane.

3. A combination according to claim 2, wherein each arm has a bulge at its upper end portion, the bulges providing said sliding surfaces and said ramp surfaces.

* * * * *